US010487485B2

(12) United States Patent
Dekoning et al.

(10) Patent No.: US 10,487,485 B2
(45) Date of Patent: Nov. 26, 2019

(54) DRAIN COVER ASSEMBLY

(71) Applicant: Kohler Co., Kohler, WI (US)

(72) Inventors: Curtis W. Dekoning, Sheboygan, WI (US); Lawrence A. Grin, Fond du Lac, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 15/817,667

(22) Filed: Nov. 20, 2017

(65) Prior Publication Data

US 2019/0153710 A1 May 23, 2019

(51) Int. Cl.
*E03C 1/23* (2006.01)
*E03C 1/14* (2006.01)

(52) U.S. Cl.
CPC ..... *E03C 1/2302* (2013.01); *E03C 1/14* (2013.01)

(58) Field of Classification Search
CPC ..... E03C 1/2302; E03C 1/2306; E03C 1/14
USPC ..... 4/653, 688, 689
See application file for complete search history.

(56) References Cited

U.S. PATENT DOCUMENTS

| | | | | |
|---|---|---|---|---|
| 4,381,569 | A | 5/1983 | Ingram | |
| 5,176,215 | A | 1/1993 | Ackerman | |
| 6,108,828 | A | 8/2000 | Cheng | |
| 6,122,775 | A | 9/2000 | Jacuzzi et al. | |
| 6,237,168 | B1 | 5/2001 | Daniel, III et al. | |
| 6,490,739 | B1 | 12/2002 | Lee | |
| 8,214,942 | B2 | 7/2012 | Yang et al. | |
| 8,590,065 | B2 * | 11/2013 | Ali | A47K 1/14 4/287 |
| 9,151,027 | B2 | 10/2015 | Lucas | |
| 9,204,762 | B2 | 12/2015 | McLeod | |
| 9,260,846 | B2 | 2/2016 | Marotz et al. | |
| 9,499,962 | B2 * | 11/2016 | Joseph | E03C 1/262 |
| 9,518,383 | B2 | 12/2016 | Lesmeister | |
| 10,301,803 | B2 * | 5/2019 | Beck | E03C 1/2306 |
| 2011/0119821 | A1 | 5/2011 | Chen | |
| 2011/0126347 | A1 * | 6/2011 | Qian | E03C 1/2302 4/287 |
| 2011/0138527 | A1 | 6/2011 | Siena | |
| 2014/0182053 | A1 | 7/2014 | Huang | |
| 2014/0373262 | A1 | 12/2014 | McLeod | |
| 2016/0208470 | A1 | 7/2016 | Franke | |
| 2016/0251839 | A1 | 9/2016 | Ali | |
| 2017/0089051 | A1 | 3/2017 | Huang | |

FOREIGN PATENT DOCUMENTS

| | | |
|---|---|---|
| EP | 2636805 | 3/2013 |
| ES | 1073405 | 12/2010 |
| WO | WO 2016006989 | 1/2016 |

OTHER PUBLICATIONS

European Search Report re EP Application EP18205754; 8 pages.

* cited by examiner

*Primary Examiner* — Huyen D Le
(74) *Attorney, Agent, or Firm* — Foley & Lardner LLP

(57) ABSTRACT

A drain cover assembly for a lavatory includes an adapter and a drain cover. The adapter includes a body and a first end portion extending from the body. The drain cover is removably coupled to the first end portion. The body is configured to removably couple to a cartridge actuator in a first configuration and a drain insert in a second configuration.

18 Claims, 5 Drawing Sheets

DRAIN COVER ASSEMBLY

BACKGROUND

The present application relates generally to the field of lavatories. More specifically, this application relates to a drain cover assembly for a lavatory.

SUMMARY

One embodiment relates to a drain cover assembly for a lavatory. The drain cover assembly includes an adapter and a drain cover. The adapter includes a body and a first end portion extending from the body. The drain cover is removably coupled to the first end portion. The body is configured to removably couple to a cartridge actuator in a first configuration and a drain insert in a second configuration.

Another embodiment relates to a drain cover assembly for a lavatory. The drain cover assembly includes an adapter and a drain cover. The adapter includes a body and a first end portion extending from an end of the body. The body includes an annular channel configured to receive a seal. The drain cover is removably coupled to the first end portion. The body includes an inner wall defining a central opening for receiving a cartridge actuator in a first configuration and a drain insert in a second configuration.

Another embodiment relates to a lavatory assembly. The lavatory assembly includes a lavatory and a drain cover assembly coupled to the lavatory. The drain cover assembly includes an adapter and a drain cover. The adapter includes a body and an end portion extending from the body. The drain cover is removably coupled to the end portion. The body is configured to removably couple to a cartridge actuator in a first configuration and a drain insert in a second configuration.

Another embodiment relates to a drain cover assembly kit. The kit comprises an adapter, a seal, and a drain cover. The adapter includes a body and a first end portion extending from an end of the body. The body includes an annular channel. The seal is removably coupled to the adapter at the annular channel for use in a clicker style drain configuration. The drain cover is removably coupled to the first end portion. The body includes an inner wall defining a central opening for receiving a cartridge actuator for use in a clicker style drain configuration, and a drain insert for use in a pop-up style drain configuration.

DETAILED DESCRIPTION

Generally speaking, a lavatory or sink can include a drain valve assembly to permit or prohibit fluid from flowing through the drain, such as from a basin of the lavatory. Most drain valve assemblies are configured either as a "pop-up" style or a "clicker" style. A pop-up style drain valve assembly typically includes a drain cover and a drain insert that is coupled to the cover, and that is configured to be inserted into a drain pipe. The drain insert can, for example, be actuated by a user via a rod assembly that is coupled to the drain insert through the drain pipe, so as to move the drain cover into and out of engagement with the lavatory to permit or prohibit fluid from flowing through the drain. The rod assembly can include a portion that is exposed on an exterior of the lavatory (e.g., above the lavatory) to provide access to a user for actuating. In contrast, a clicker style drain valve assembly typically includes a drain cover and a cartridge actuator coupled to the drain cover. The cartridge actuator can be coupled to a control assembly within the drain pipe, such that linear actuation of the cartridge actuator can open and close the actuator (thereby creating a "clicking" sound) to permit or prohibit fluid from flowing through the drain pipe.

The components of a pop-up style drain assembly typically are not interchangeable with the components of a clicker style drain assembly, due to the significant differences in design and functionality. Thus, a pop-up style drain assembly typically includes a different drain cover and is configured differently, as compared to a clicker style drain assembly, which may include additional components and may have a different overall design.

Referring generally to the FIGURES, disclosed herein is a modular drain cover assembly that is reconfigurable as either a pop-up style drain assembly or a clicker style drain assembly. The modular drain cover assembly includes an adapter that can, advantageously, allow for reconfiguration of the assembly to accommodate different drain configurations. Furthermore, the modular design allows for commonality of components between the different assemblies, so as to minimize the need for additional components, thereby reducing manufacturing costs and simplifying assembly operations.

Figure 1:
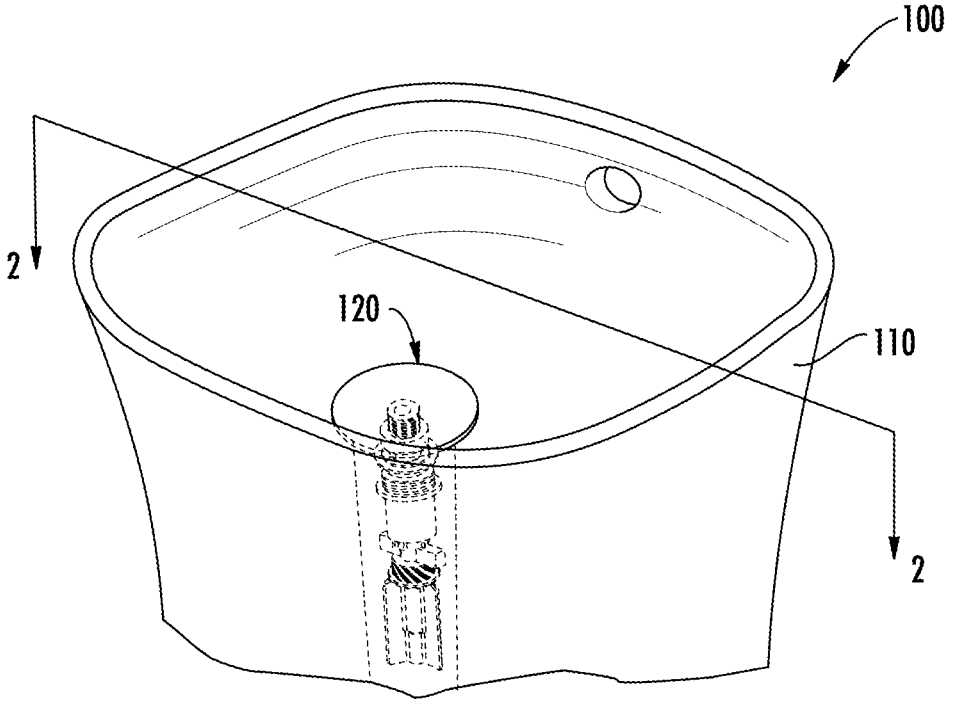
FIG. 1 is a partial perspective view of a lavatory assembly including a lavatory and a drain cover assembly according to an exemplary embodiment.
Figure 2:
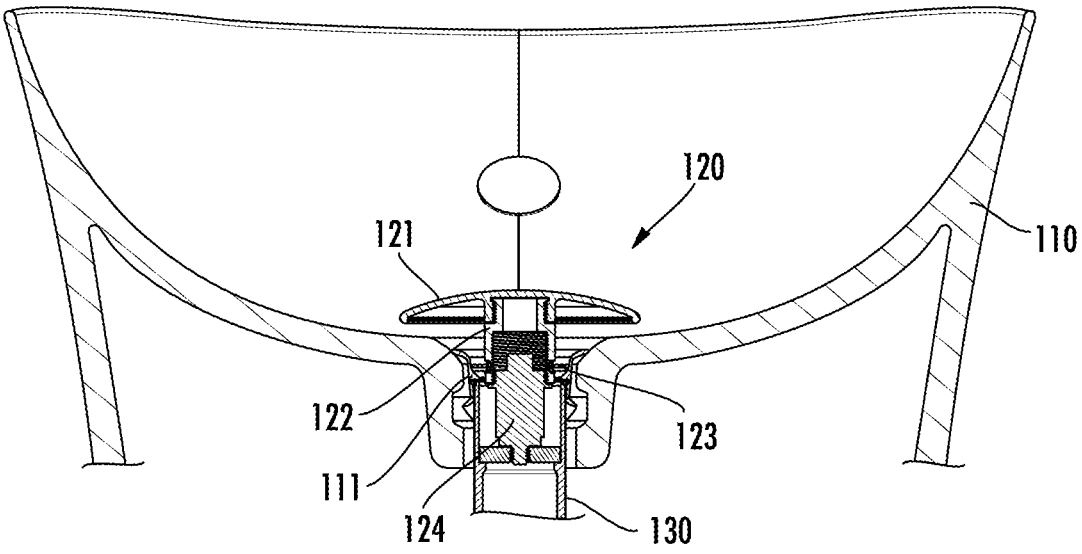
FIG. 2 is a cross-sectional view of the lavatory assembly of FIG. 1 taken along line 2-2 in FIG. 1.

Referring to FIGS. 1-2, a lavatory assembly 100 is shown according to an exemplary embodiment. The lavatory assembly 100 includes a lavatory 110 (e.g., sink, basin, etc.) and a drain cover assembly 120 (e.g., drain valve assembly, drain assembly, etc.) coupled to a drain pipe 130 of the lavatory 110. According to other exemplary embodiments, the drain cover assembly 120 can be used across other types of sinks or basins including drains, such as bathtubs, kitchen sinks, utility sinks, or the like.

In the embodiment of FIG. 2, the drain cover assembly 120 is configured as a clicker style drain valve assembly. The drain cover assembly 120 includes a cover 121 (e.g., drain cover, drain cap, etc.) removably coupled to an adapter 122. The adapter 122 includes a seal 123 removably coupled thereto. The seal 123 is configured to sealingly engage a portion of a drain (e.g., drain 111, drain pipe 130, etc.), so as to prohibit fluid from flowing from the basin of the lavatory 110 through the drain pipe 130. The adapter 122 is removably coupled to a cartridge actuator 124 (e.g., clicker cartridge, etc.). According to various exemplary embodiments, the cartridge actuator 124 can be configured as any one of the clicker cartridge actuators disclosed in U.S. patent application Ser. No. 13/588,503 (now U.S. Pat. No. 9,260,846), titled "DRAIN CONTROL ASSEMBLY," the entire disclosure of which is hereby incorporated by reference herein. The cartridge actuator 124 is disposed in the drain pipe 130, and can be actuated between an open and a closed position, such that the seal 123 selectively engages to, and disengages from, a portion of the drain.

Figure 3:
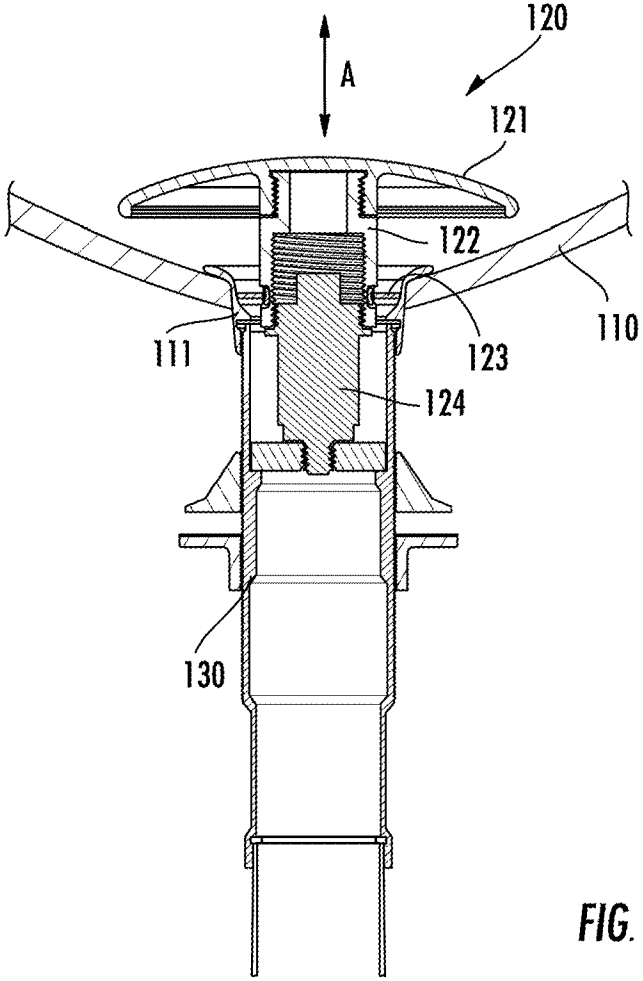
FIG. 3 is a cross-sectional view of the drain cover assembly of FIG. 1.

For example, referring to FIGS. 2-3, the drain cover assembly 120 is shown in a closed position in which fluid flowing from the lavatory 110 is prohibited from passing through the drain pipe 130. As shown, the seal 123 is sealingly engaged with a portion of the drain (e.g., drain 111, drain pipe 130, etc.), so as to prevent or impede fluid from flowing from the lavatory 110 through the drain pipe 130. The cartridge actuator 124 can be selectively moved to an open position to allow fluid to flow through the drain pipe 130 by selectively moving the drain cover 121 in an upward direction indicated generally by arrow "A" in FIG. 3. This will actuate the cartridge actuator 124, thereby causing the seal 123 to move upward and disengage from the drain to allow fluid to flow therethrough.

Figure 4:
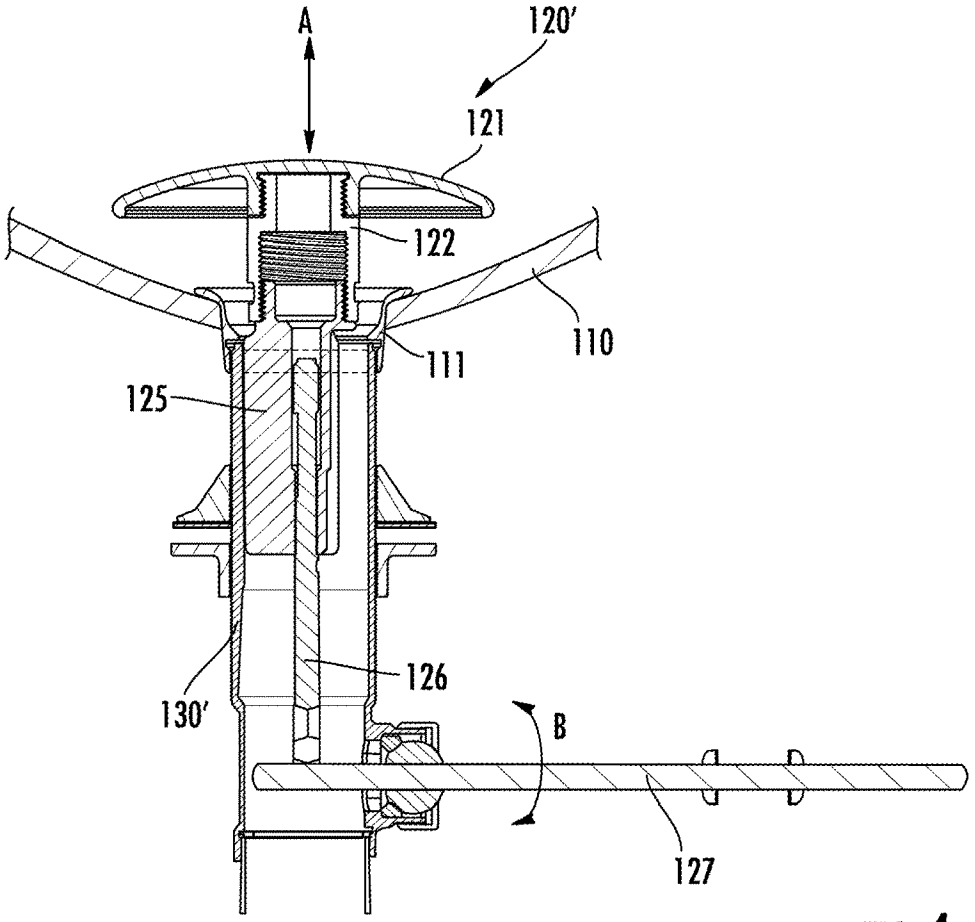
FIG. 4 is a cross-sectional view of another drain cover assembly for use in the lavatory of FIG. 1, according to another exemplary embodiment.

Referring to FIG. 4, a drain cover assembly 120' is shown according to another exemplary embodiment. The drain cover assembly 120' is the same as drain cover assembly 120, but is configured as a pop-up style drain valve assembly including a drain insert 125 (e.g., pop-up actuator, etc.) instead of a clicker cartridge actuator 124. The adapter 122, advantageously, allows for the same drain cover 121 to be used across both clicker style and pop-up style drain configurations, without the need for additional components or modifications to the assembly. For example, the drain cover assembly 120 can be easily reconfigured without the need for special tools by swapping the cartridge actuator 124 with the drain insert 125, or vice versa, such that the drain cover assembly can be used across different drain configurations.

As shown in FIG. 4, the drain cover assembly 120' includes the drain cover 121 removably coupled to the adapter 122. The adapter 122 is removably coupled to the drain insert 125, which is disposed in a portion of a drain pipe 130.' In this embodiment, the seal 123 is removed from the adapter 122 to accommodate the pop-up style drain configuration. The drain cover assembly is configured such that an ordinary user or an installer can remove the seal 123 from the adapter 122 without the need for special tools (e.g., pliers, wrenches, screwdrivers, etc.). Likewise, a user or an installer can easily remove the cartridge actuator 124 from the adapter 122 and replace it with the drain insert 125, or vice versa, without the need for special tools (e.g., pliers, wrenches, screwdrivers, etc.). As shown, the drain pipe 130' is configured as a pop-up style drain including a rod assembly having a first rod 126 coupled to the drain insert 125, and a second rod 127 coupled to the first rod 126. The second rod 127 is also pivotably coupled to a portion of the drain pipe 130' (e.g., via a ball-joint, etc.). An external actuator (i.e., above the lavatory 110) can be coupled to the second rod 127 to allow a user to actuate the rod assembly from above the lavatory 110, so as to move the drain cover 121 into and out of engagement with a portion of the lavatory 110, thereby permitting or prohibiting fluid from flowing through the drain pipe 130.'

For example, referring to FIG. 4, the drain cover assembly 120' is shown in an open position in which fluid is permitted to flow from the lavatory 110 through the drain pipe 130.' The second rod 127 can, for example, be actuated by pulling an external actuator coupled to the second rod 127 and located above the lavatory 110, such that the second rod 127 pivots or rotates in a direction indicated generally by arrow "B" in FIG. 4. The pivoting motion of the second rod 127 can cause the first actuator 126 to move linearly in a direction indicated generally by arrow "A" in FIG. 4. The linear motion of the first rod 126, in turn, can cause the drain insert 125 to move in the same direction, thereby causing the drain cover 121 to move downward and engage an inner surface of the lavatory 110. In this way, the drain cover 121 can prohibit fluid from flowing from the lavatory 110 into the drain pipe 130.'

Figure 5:
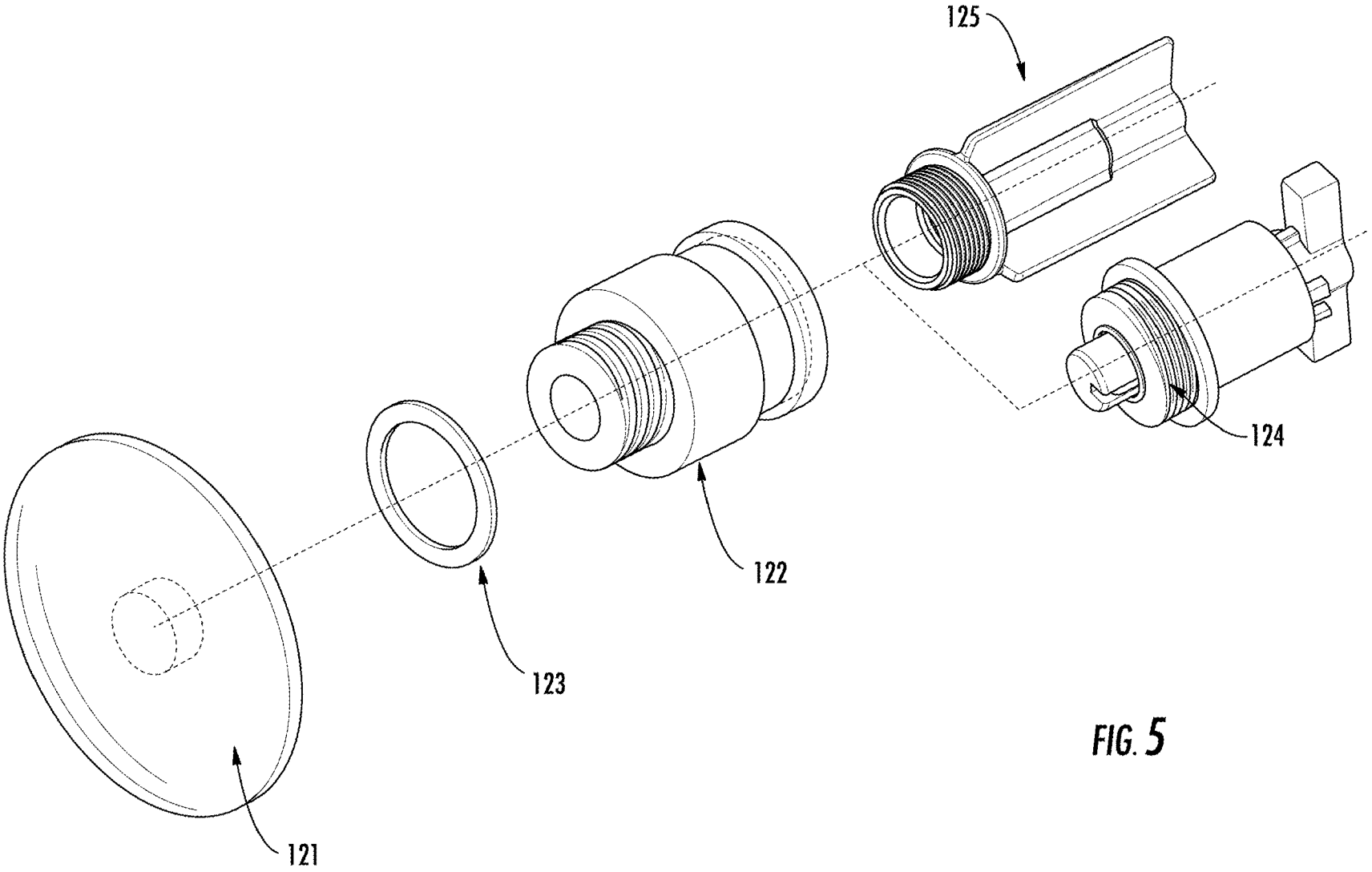
FIG. 5 is an exploded view of the drain cover assemblies of FIGS. 3-4.

Referring to FIG. 5, an exploded view of the drain cover assemblies 120, 120' is shown. As illustrated, the drain cover assemblies 120, 120' have a common drain cover 121 and adapter 122. The adapter 122 can receive a removable seal 123 and a cartridge actuator 124 to configure the drain cover assembly 120' for use in a clicker style drain. The seal 123 and the cartridge actuator 124 can be selectively removed from the adapter 122, without the need for special tools, and a drain insert 125 can be selectively coupled to the adapter 122 to configure the drain cover assembly 120 for use in a pop-up style drain. In this manner, the drain cover assemblies 120, 120' have interchangeable components and are easily reconfigurable to accommodate different drain configurations, without the need for special tools or additional components.

Figure 6:
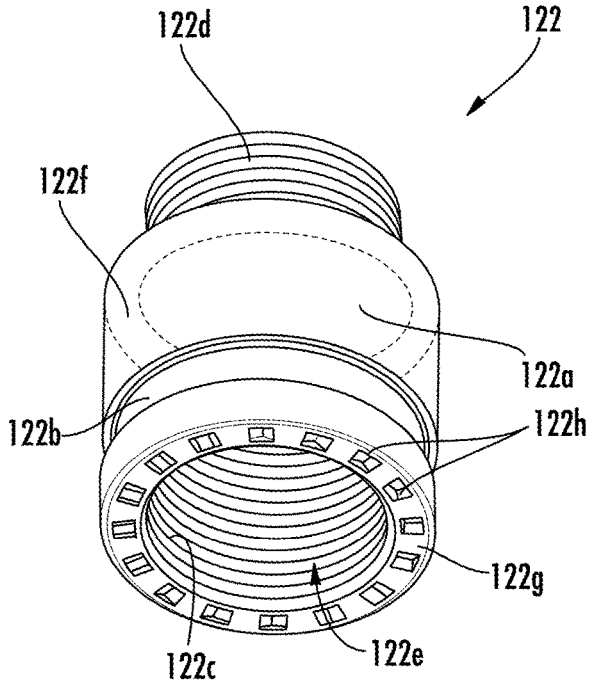
FIG. 6 is a perspective view of an adapter for use in the drain cover assemblies of FIGS. 3-4 according to an exemplary embodiment.

Referring to FIG. 6, the adapter 122 is shown according to an exemplary embodiment. As shown in the embodiment of FIG. 6, the adapter 122 includes a body **122*a* having a generally cylindrical shape. The body 122*a* includes an annular channel 122*b* (e.g., recess, slot, groove, etc.) disposed along the circumferential periphery of the body 122*a*. According to other exemplary embodiments, the annular channel 122*b* extends partially along the circumferential periphery of the body 122*a*. The annular channel 122*b* can receive the seal 123 and retain the seal 123 on the body 122*a*. The annular channel 122*b*, advantageously, allows for the seal 123 to be removably coupled to the body 122*a* such that a user or an installer can add or remove the seal 123 to or from the body 122*a*** without the need for special tools, so as to reconfigure the assembly.

Still referring to FIG. 6, the adapter 122 includes a first end portion **122*d* extending from the body 122*a*. The first end portion 122*d* includes an outer surface having a plurality of threads for removably coupling the drain cover 121 thereto (i.e., threadably coupling). According to other exemplary embodiments, the first end portion 122*d* can include other structural features for removably coupling to the drain cover 121, such as snap features, press-fit features, twist-and-lock features, or other structural features to facilitate assembly/disassembly of the adapter 122 and the drain cover 121 without the need for special tools. The first end portion 122*d* has a diameter that is less than the diameter of the body 122*a*, so as to define a shoulder 122*f* (e.g., flange, etc.). The shoulder 122*f* can, advantageously, act as a stop feature for limiting a position of the drain cover 121 relative to the adapter 122 (see, for example, FIGS. 2-4**).

As shown in FIG. 6, the body **122*a* is substantially hollow and includes an inner wall 122*c* defining a central opening 122*e* therein. The inner wall 122*c* includes a plurality of threads for removably coupling to either the cartridge actuator 124 or the drain insert 125, depending on the particular application of the drain cover assembly. According to other exemplary embodiments, the inner wall 122*c* can include other structural features for removably coupling to the cartridge actuator 124 or the drain insert 125, such as snap features, press-fit features, twist-and-lock features, or other structural features to facilitate assembly/disassembly between the adapter 122 and the cartridge actuator 124/drain insert 125 without the need for special tools. The body 122***a* further includes a second end portion 122*g* that can, advantageously, act as a stop feature to limit a position of the cartridge actuator 124 or the drain insert 125 relative to the adapter 122. In addition, the second end portion 122*g* includes a plurality of protrusions 122*h* (e.g., knurls, crush features, etc.) that can function to maintain or secure a relative position between the adapter 122 and the cartridge actuator 124 or drain insert 125. For example, a portion of the cartridge actuator 124 or the drain insert 125 can contact the protrusions 122*h* when coupled to the adapter 122, such that the protrusions create an interference condition with a mating surface of the cartridge actuator 124 (e.g., shoulder 124*d*) or the drain insert 125 (e.g., shoulder 125*b*), to thereby maintain a relative position to the adapter 122.

Figure 7:
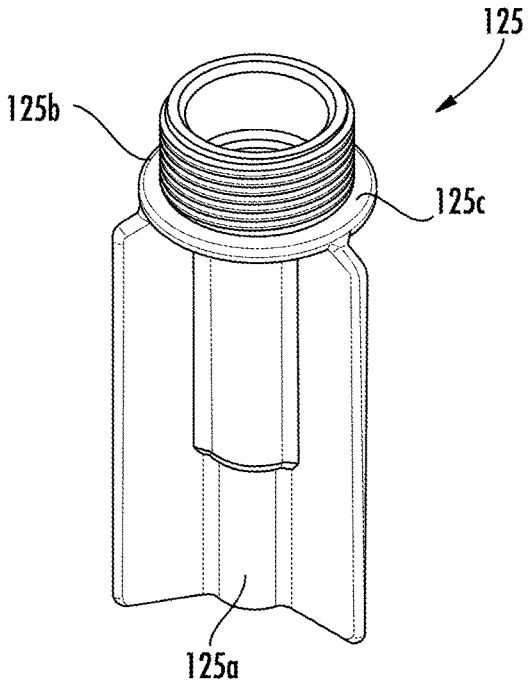
FIG. 7 is a perspective view of a drain insert for use in the drain cover assembly of FIG. 4.

Referring to FIG. 7, the drain insert 125 is shown according to an exemplary embodiment. As shown in FIG. 7, the drain insert includes a base 125*a* that is configured to be inserted into a drain (e.g., drain pipe 130'). The base 125*a* can be removably coupled to a first rod 126 as part of a pop-up style drain assembly (see, for example, FIG. 4). The drain insert 125 further includes an upper portion 125*b* extending from an end of the base 125*a*. The upper portion 125*b* includes a plurality of external threads that are configured to threadably engage the plurality of threads disposed on the inner surface 122*c* of the adapter 122, so as to removably couple the drain insert 125 to the adapter 122. The drain insert 125 includes a flange 125*e* (e.g., shoulder, etc.) extending outwardly between the base 125*a* and the upper portion 125*b*. The flange 125*e* can, advantageously, act as a stop feature to limit the relative position of the drain insert 125 relative to the adapter 122. The flange 125*e* includes an upper mating surface 125*c* that is configured to engage the plurality of protrusions 122*h* on the adapter 122, so as to maintain a relative position between the adapter 122 and the drain insert 125 when coupled thereto.

Figure 8:
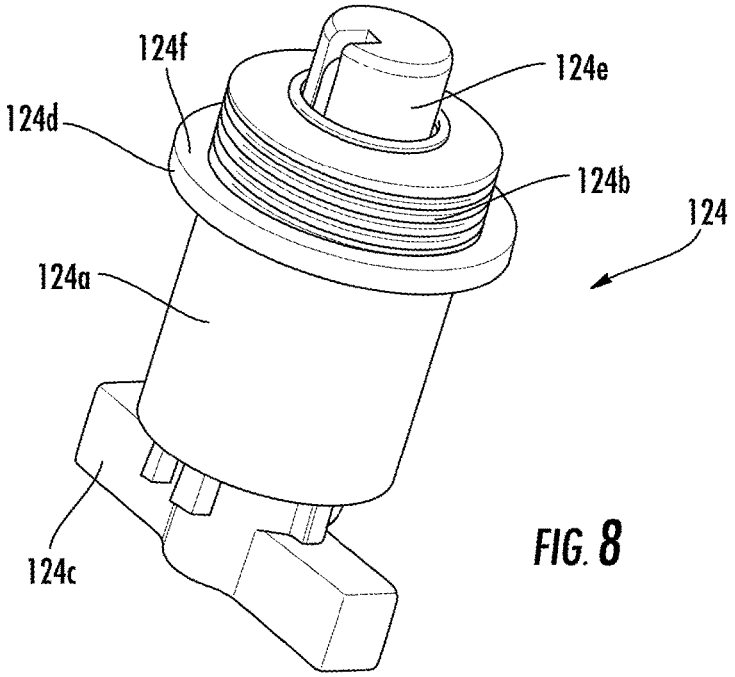
FIG. 8 is a perspective view of a clicker cartridge actuator for use in the drain cover assembly of FIG. 3.

Referring to FIG. 8, the cartridge actuator 124 is shown according to an exemplary embodiment. As shown in FIG. 8, the cartridge actuator 124 includes a body 124*a*, an engaging feature 124*c*, and a biasing member 124*e*, which collectively define a cartridge unit. The body 124*a* further includes an upper portion 124*b* extending from an end of the body 124*a*. The upper portion 124*b* includes a plurality of external threads that are configured to threadably engage the plurality of threads disposed on the inner surface 122*c* of the adapter 122, so as to removably couple the cartridge actuator 124 to the adapter 122. The cartridge actuator 124 includes a flange 124*d* (e.g., shoulder, etc.) extending outwardly between the body 124*a* and the upper portion 124*b*. The flange 124*d* can, advantageously, act as a stop feature to limit the relative position of the cartridge actuator 124 relative to the adapter 122. The flange 124*d* includes an upper mating surface 124*f* that is configured to engage the plurality of protrusions 122*h* on the adapter 122, so as to maintain a relative position between the adapter 122 and the cartridge actuator 124 when coupled thereto.

Figure 9:
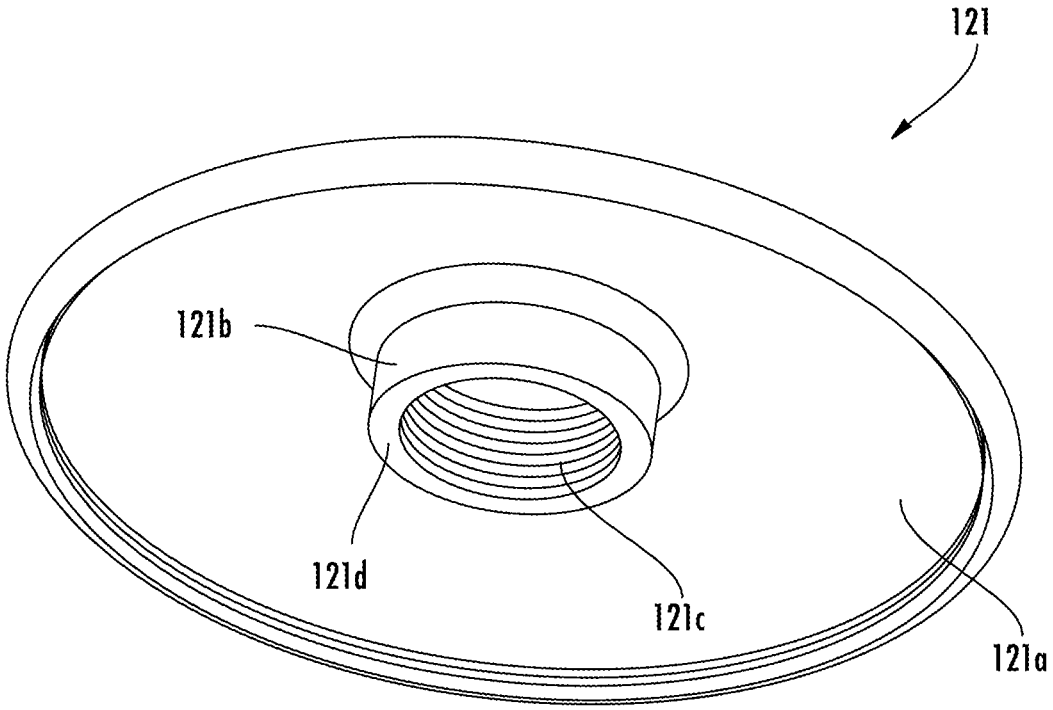
FIG. 9 is a perspective view of a drain cover for use in the drain cover assemblies of FIGS. 3-4.

Referring to FIG. 9, the drain cover 121 is shown according to an exemplary embodiment. As shown in FIG. 9, the drain cover 121 has a generally disc shaped body 121*a* that can, for example, conceal a drain opening from view (e.g., drain 111 in FIGS. 1-2). The body 121*a* includes a stem 121*b* extending from an inner surface of the body 121*a*. The stem 121*b* has a hollow cylindrical shape that is defined by an inner surface 121*c*. The inner surface 121*c* includes a plurality of threads that are configured to threadably engage the plurality of threads disposed on the first end portion 122*d* of the adapter 122, so as to removably couple the drain cover 121 to the adapter 122, without the need for special tools. A distal end 121*d* of the stem 121*b* can engage the shoulder 122*f* of the adapter 122 to limit a position of the drain cover 121 relative to the adapter 122.

As disclosed herein, the drain cover assemblies 120, 120' have a common drain cover 121 and adapter 122. The adapter 122 can receive a removable seal 123 and a cartridge actuator 124 to configure the drain cover assembly 120' for use in a clicker style drain. The seal 123 and the cartridge actuator 124 can be selectively removed from the adapter 122, without the need for special tools, and a drain insert 125 can be selectively coupled to the adapter 122 to configure the drain cover assembly 120 for use in a pop-up style drain. In this manner, the drain cover assemblies 120, 120' have interchangeable components and are easily reconfigurable to accommodate different drain configurations, without the need for special tools or additional components.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the application as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the faucets as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present application. For example, any element (e.g., adapter, drain cover, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments.

What is claimed is:

1. A drain cover assembly for a lavatory, the drain cover assembly comprising:

an adapter including a body and a first end portion extending from the body; and a drain cover removably coupled to the first end portion;

wherein the body is configured to removably couple to a cartridge actuator in a first configuration and a drain insert in a second configuration;

wherein the body includes an annular channel, and wherein the annular channel is configured to receive a seal.

2. The drain cover assembly of claim 1, further comprising a seal removably coupled to the body at the annular channel, wherein the seal is configured to sealingly engage a drain of a lavatory.

3. The drain cover assembly of claim 1, wherein the body includes an inner wall having a plurality of threads for removably coupling to a cartridge actuator in a first configuration and to a drain insert in a second configuration.

4. A drain cover assembly for a lavatory, the drain cover assembly comprising:

an adapter including a body and a first end portion extending from the body; and a drain cover removably coupled to the first end portion;

wherein the body is configured to removably couple to a cartridge actuator in a first configuration and a drain insert in a second configuration;

wherein the first end portion has a diameter that is less than a diameter of the body to define a shoulder, and wherein the shoulder is configured to limit a position of the drain cover relative to the adapter.

5. The drain cover assembly of claim 4, wherein the drain cover includes a body and a stem extending from an inner surface of the body, and wherein the drain cover is removably coupled to the adapter at the stem.

6. The drain cover assembly of claim 4, wherein the adapter includes a second end portion opposite the first end portion, and wherein the second end portion is configured to limit a position of a cartridge actuator relative to the adapter in a first configuration and a drain insert relative to the adapter in a second configuration.

7. The drain cover assembly of claim 6, wherein the second end portion includes a plurality of protrusions configured to create an interference condition between the adapter and the cartridge actuator in the first configuration and the adapter and the drain insert in the second configuration.

8. A drain cover assembly, comprising:

an adapter including a body and a first end portion extending from an end of the body, wherein the body includes an annular channel configured to receive a seal; and a drain cover removably coupled to the first end portion;

wherein the body includes an inner wall defining a central opening for receiving a cartridge actuator in a first configuration and a drain insert in a second configuration.

9. The drain cover assembly of claim 8, further comprising a seal removably coupled to the body at the annular channel, wherein the seal is configured to sealingly engage a drain of a lavatory.

10. The drain cover assembly of claim 8, wherein the inner wall includes a plurality of threads for removably coupling to a cartridge actuator in a first configuration and to a drain insert in a second configuration.

11. The drain cover assembly of claim 8, wherein the first end portion has a diameter that is less than a diameter of the body to define a shoulder, and wherein the shoulder is configured to limit a position of the drain cover relative to the adapter.

12. The drain cover assembly of claim 8, wherein the drain cover includes a body and a stem extending from an inner surface of the body, and wherein the drain cover is removably coupled to the first end portion at the stem.

13. The drain cover assembly of claim 12, wherein the stem includes an inner surface having a plurality of threads for threadably engaging the first end portion of the adapter.

14. The drain cover assembly of claim 8, wherein the adapter includes a second end portion opposite the first end portion, and wherein the second end portion is configured to limit a position of a cartridge actuator relative to the adapter in a first configuration and a drain insert relative to the adapter in a second configuration.

15. The drain cover assembly of claim 14, wherein the second end portion includes a plurality of protrusions configured to create an interference condition between the adapter and a cartridge actuator in a first configuration and the adapter and a drain insert in a second configuration.

16. A lavatory assembly comprising:

a lavatory; and a drain cover assembly coupled to the lavatory, the drain cover assembly comprising:

an adapter including a body and an end portion extending from the body; and a drain cover removably coupled to the end portion;

wherein the body is configured to removably couple to a cartridge actuator in a first configuration and a drain insert in a second configuration;

wherein the body includes an annular channel, and wherein the annular channel is configured to receive a seal.

17. The drain cover assembly of claim 16, further comprising a seal removably coupled to the body at the annular channel, wherein the seal is configured to sealingly engage a drain of the lavatory.

18. The drain cover assembly of claim 16, wherein the drain cover includes a body and a stem extending from an inner surface of the body, and wherein the drain cover is removably coupled to the end portion at the stem.

* * * * *